US009401266B2

(12) United States Patent
Splendore et al.

(10) Patent No.: US 9,401,266 B2
(45) Date of Patent: Jul. 26, 2016

(54) FILAMENT FOR MASS SPECTROMETRIC ELECTRON IMPACT ION SOURCE

(71) Applicant: Bruker Daltonics, Inc., Billerica, MA (US)

(72) Inventors: Maurizio Splendore, Walnut Creek, CA (US); Felician Muntean, Danville, CA (US); Roy P. Moeller, San Leandro, CA (US)

( * ) Notice: Subject to any disclaimer, the term of this patent is extended or adjusted under 35 U.S.C. 154(b) by 0 days.

(21) Appl. No.: 14/341,076

(22) Filed: Jul. 25, 2014

(65) Prior Publication Data

US 2016/0027630 A1 Jan. 28, 2016

(51) Int. Cl.

| | |
|---|---|
| ***H01J 49/00*** | (2006.01) |
| ***H01J 49/14*** | (2006.01) |
| ***H01J 27/20*** | (2006.01) |

(52) U.S. Cl.

CPC ..... *H01J 49/147* (2013.01); *H01J 27/205* (2013.01)

(58) Field of Classification Search

USPC ..... 250/427

See application file for complete search history.

(56) References Cited

U.S. PATENT DOCUMENTS

| | | | | |
|---|---|---|---|---|
| 4,080,548 | A * | 3/1978 | Johnson | 315/68 |
| 4,156,159 | A * | 5/1979 | Takagi | H01J 27/22 313/155 |
| 4,816,685 | A | 3/1989 | Lange | |
| 5,404,069 | A * | 4/1995 | Olwert | H01K 3/06 313/271 |
| 5,436,528 | A * | 7/1995 | Paranjpe | H05H 1/46 313/231.31 |
| 5,543,625 | A * | 8/1996 | Johnson | H01J 27/022 250/427 |
| 6,239,429 | B1 * | 5/2001 | Blessing | H01J 49/068 250/281 |
| 2014/0374583 | A1 * | 12/2014 | Prest et al. | 250/282 |
| 2015/0187557 | A1 * | 7/2015 | Barofsky et al. | 250/288 |

FOREIGN PATENT DOCUMENTS

| | | | |
|---|---|---|---|
| DE | 2139250 | A1 | 2/1973 |
| GB | 2070853 | A1 | 9/1981 |
| JP | 05135734 | A1 | 6/1993 |
| WO | 2005045877 | A1 | 5/2005 |
| WO | 2014028695 | A1 | 2/2014 |

* cited by examiner

*Primary Examiner* — Phillip A Johnston
(74) *Attorney, Agent, or Firm* — Benoit & Cote, Inc.

(57) ABSTRACT

The invention provides a cathode system for an Electron Ionization (EI) source comprising a filament and current supply posts, the current supply posts dividing the filament into segments and each current supply post supplying or returning the current for at least two segments of the filament. Each filament segment is connected, for instance by spot welding, to the supply posts delivering the heating current. The filament segments may be arranged in a row, or substantially parallel to each other. Filament segments arranged in a row may form a closed loop, for instance, a ring. Other embodiments encompass the filament shape of a helical coil.

17 Claims, 5 Drawing Sheets

FILAMENT FOR MASS SPECTROMETRIC ELECTRON IMPACT ION SOURCE

BACKGROUND OF THE INVENTION

1. Field of the Invention

The invention relates to filaments used as electron emitting cathodes in electron impact ion sources for mass spectrometers (MS).

2. Description of the Related Art

Electron impact ionization, or more correctly Electron Ionization (EI), is a common type of ionization in gas chromatography-mass spectrometry (GC-MS). The EI source offers predictable fragmentation favorable for compound identification using commercially available libraries with several hundred thousand reference spectra, e.g., the library of the National Institute for Standards and Technology (NIST). The EI source furthermore offers uniform response for most compounds because the ionization efficiency is mostly not compound dependent.

The classical EI ion source is the cross-beam ion source wherein an electron beam generated by a linear glow cathode is accelerated through a slit to about 70 electronvolts, is guided by a weak magnetic field through an ionization region, exits through another slit and hits an electron detector used to regulate the electron current by controlling the electric current through the cathode. FIG. 1 shows schematically such a known cross-beam EI ion source. Effluents of the GC are blown through the ionizing electron curtain, and the ions generated are drawn out of the ionization region through slitted electrodes. This type of ion source is ideally suited for mass spectrometers operated with slits, e.g. magnetic sector mass spectrometers.

Today, however, most mass spectrometers are designed to accept cylindrically symmetric ion beams because they are regularly equipped with elongate quadrupole ion guides or quadrupole filters which encase a cylindrical inner volume. Ion sources with slits generating non-cylindrical ion beams no longer fulfill modern requirements in an optimum way. This mismatch may lead to ion beam losses in the ion source or in the ion extraction optics, or to an undesired widening of the ion energy distribution, or to an ion beam symmetry distortion further down the MS.

For a better match with the rest of the ion path into the mass spectrometer, cylindrically symmetric EI ion sources and especially cylindrically symmetric EI filament arrangements have been developed (see, e.g., M. DeKieviet et al., "Design and performance of a highly efficient mass spectrometer for molecular beams", Rev. Scient. Instr. 71(5): 2015-2018, 2000, or A. V. Kalinin et al., "Ion Source with Longitudinal Ionization of a Molecular Beam by an Electron Beam in a Magnetic Field", Instr. and Exp. Techn. 49(5): 709-713, 2006).

In the cited articles, ring-shaped filaments have been mounted in the stray field of the coil of an electromagnet so that the electrons are accelerated along the field lines into the center of the coil, thereby forming a narrow tubular electron beam. This principle is shown schematically in FIG. 2. The effluents of the GC are blown as a molecular beam through the ring-shaped filament into the coil of the magnet. The molecules of the effluents are ionized on the fly with high efficiency by the tubular electron beam.

A classical ring-shaped filament arrangement is shown in FIG. 3. Circular or cylindrically symmetric filament assemblies, such as ring-shaped filaments, however, run the risk of losing shape after cycles of repeated heating and cooling. Providing additional support posts used to reduce the freedom to deform, as shown in FIG. 4 for example, results in heat being carried away via the posts and leads to different electron emission characteristics over the regions of non-uniform temperature.

In view of the foregoing, there is a need for filament arrangements for EI sources in mass spectrometers, which do not lose shape and show an electron emission as constant as possible along the filament arrangement.

SUMMARY OF THE INVENTION

The invention provides a cathode system for an EI ion source comprising a filament and a plurality of current supply posts, the plurality of current supply posts (electrically) dividing the filament into a plurality of segments and each current supply post supplying or returning the electric current for at least two segments of the filament. The filament is connected, for instance by spot welding, to the supply posts delivering or returning the heating current. The filament segments may be arranged in a row, or substantially parallel to each other. Filament segments arranged in a row may form a closed loop, for instance, a ring. Other embodiments encompass the shape of a helical coil.

The filaments are preferentially fabricated from Tungsten, thoriated Tungsten, Rhenium, Yttrium coated Rhenium, or especially Yttrium/Rhenium alloys. The current supply posts may favorably be shaped in such a manner that they are heated by the current near their contact to the filament to a temperature which corresponds to the temperature of the filament. To achieve identical temperatures in the different filament segments, the material of some of the filament segments may be ablated, for instance by laser ablation, to have the same (or roughly the same) electron emission in all segments. The ablation may be controlled by measuring the electron emission of the individual segments.

BRIEF DESCRIPTION OF THE DRAWINGS

The invention can be better understood by referring to the following figures. The elements in the figures are not necessarily to scale, emphasis instead being placed upon illustrating the principles of the invention (often schematically). In the figures, like reference numerals generally designate corresponding parts throughout the different views.

DETAILED DESCRIPTION

Figure 1:
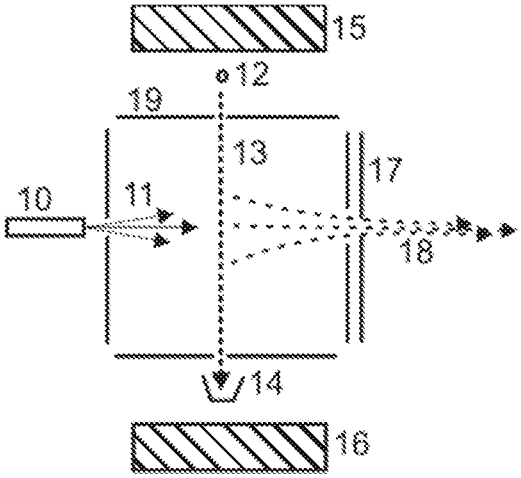
FIG. 1 presents a traditional cross-beam electron impact ion source. Effluents (11) from the end of a GC capillary (10) cross the electron beam (13). The electron beam is generated by cathode (12), accelerated by aperture (19) to about 70 electronvolts, guided by a weak magnetic field between permanent magnets (15) and (16) through the ionization region, and detected by Faraday cup (14). The ions are extracted by applying extraction voltages at apertures (17) and formed to an ion beam (18). The permanent magnets are connected by a yoke (not shown), surrounding the ion source.
Figure 2:
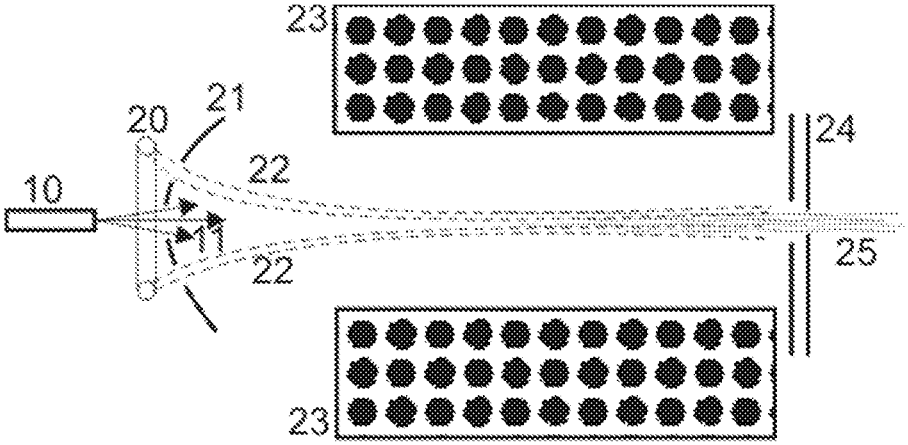
FIG. 2 depicts schematically a more modern high efficiency EI ion source in which the electron beam (22) is generated by a ring-shaped cathode (20), accelerated by a curved electrode (21), and concentrated into a narrow tube within the stray field of an electromagnet (23). The ions are extracted through apertures (24) and formed to a cylindrical ion beam (25).
Figure 3:
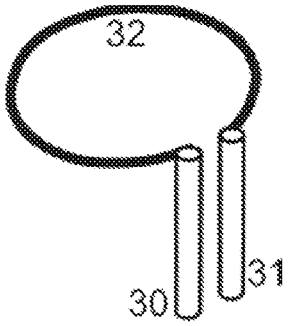
FIG. 3 shows a conventional ring electrode (32), supplied with current by the two posts (30) and (31). This ring electrode is easily deformed by periods of repeated heating and cooling thereby affecting its performance.
Figure 4:
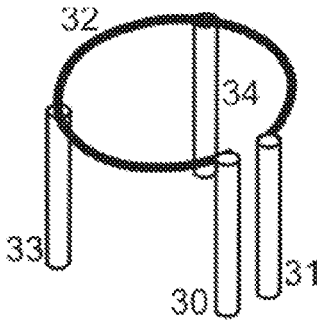
FIG. 4 depicts how the ring electrode of FIG. 3 can be mechanically supported by additional (electrically disconnected) holding posts (33) and (34) made either from insulating material or from electrically disconnected metal. In both cases, the temperature of the filament is prone to dropping in the vicinity of the holding posts because heat is being carried away via the posts.
Figure 5:
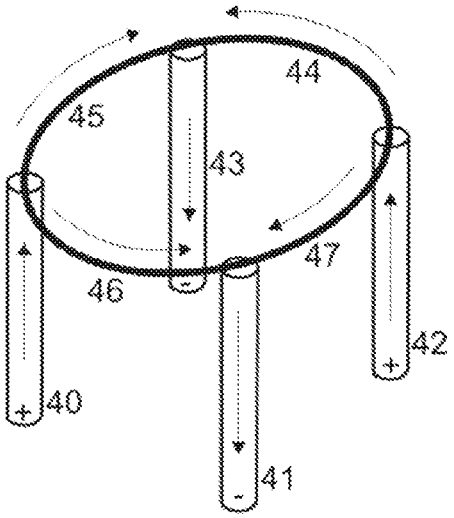
FIG. 5 presents schematically a filament system according to principles of the invention. The ring filament is (electrically) divided by the four posts (40) to (43) into the four segments (44) to (47). The current is supplied by posts (40) and (42), as indicated by a plus sign, and returned by posts (41) and (43), as indicated by a minus sign. Along the ring, the direction of the current changes four times in this example as indicated by the arrows.
Figure 6:
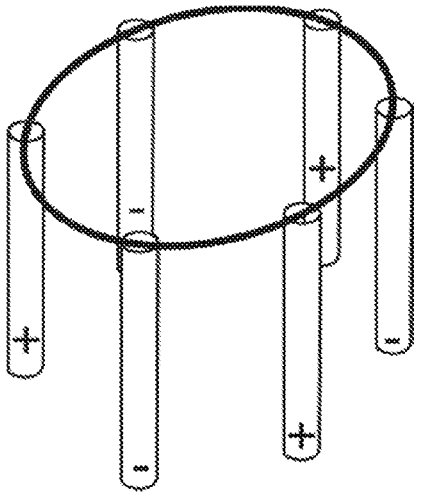
FIG. 6 shows a yet more stable ring filament system with six current carrying posts in which the direction of the current changes six times.
Figure 8:
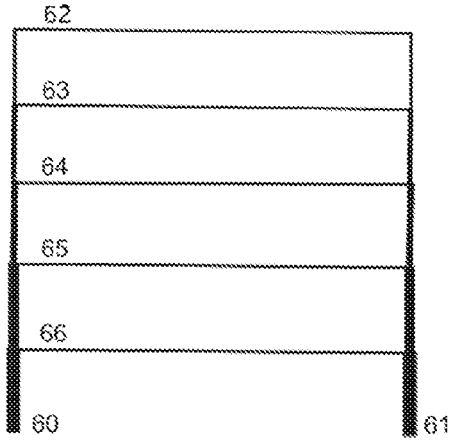
FIG. 8 presents a grid consisting of five linear and parallel filament segments (62) to (66), with only two posts (60) and (61), supplying and returning the current, respectively. The diameter of the posts is reduced from contact to contact in this example.
Figure 12:
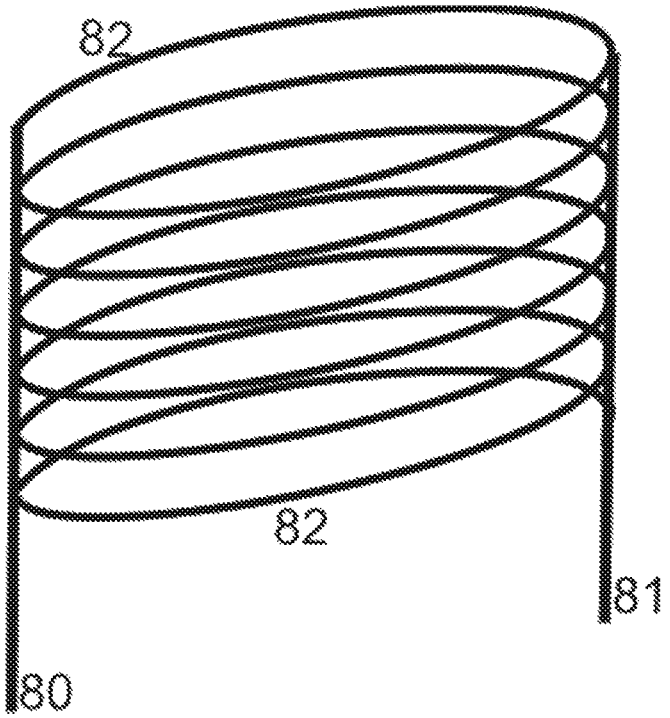
FIG. 12 shows a helical filament (82), the segments of which (half windings) are welded to two current supplying posts (80) and (81). As has been shown before in FIG. 8, the diameter of the supply posts (80) and (81) could also become smaller beyond each winding contact point.
Figure 13:
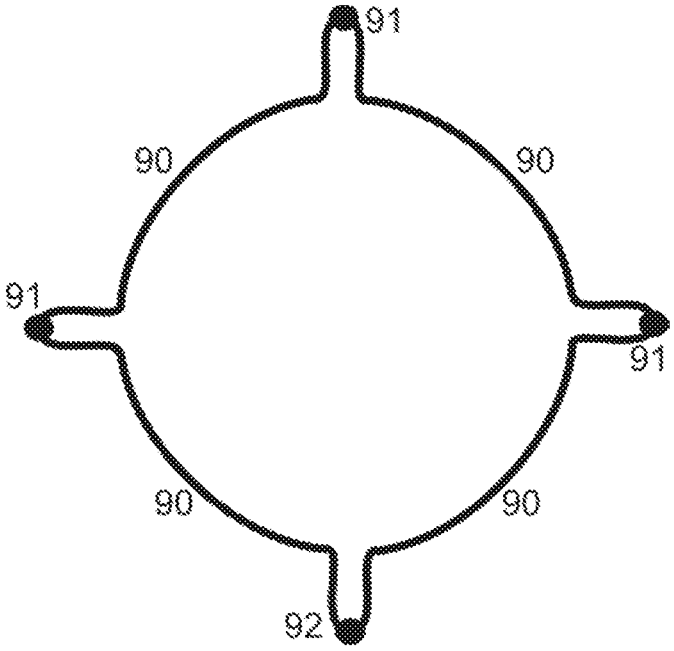
FIG. 13 depicts an essentially ring-shaped filament (90) with four small convexities welded to four current supplying posts (91). Any thermal elongation of the filament is widely absorbed by the convexities so that, regardless of thermal stress, the ring remains largely in its original position thereby relieving the posts from mechanical stress and affording for a favorably stable electron emission geometry over a wide temperature range.

The invention provides a cathode system for an EI ion source comprising a filament (electrically) divided into segments by current supply posts, each current supply post supplying or returning the current for at least two segments of the filament. Each segment is connected at both ends to supply posts supplying or returning the electric current to heat the filament. The connection may be performed as usual by spot welding, or by laser spot welding. A good electric contact is achieved if the filament is partly embedded into a groove at the top of the current supply post before spot welding. The segments may be arranged in a row, or parallel to each other. Segments arranged in a row may form a closed loop, for instance, a ring. FIG. 5 shows an embodiment of a ring-shaped filament divided into four segments by four current supply posts; in FIG. 6, an example of (electrically) dividing the ring-shaped filament into six segments is depicted. FIG. 8 presents a grid-like bundle of filaments, connected to only two current delivering posts, the filaments being essentially linear and arranged parallel to each other, whereas FIG. 12 shows a helical filament fastened in segments (half windings) to only two current supply posts.

Figure 9:
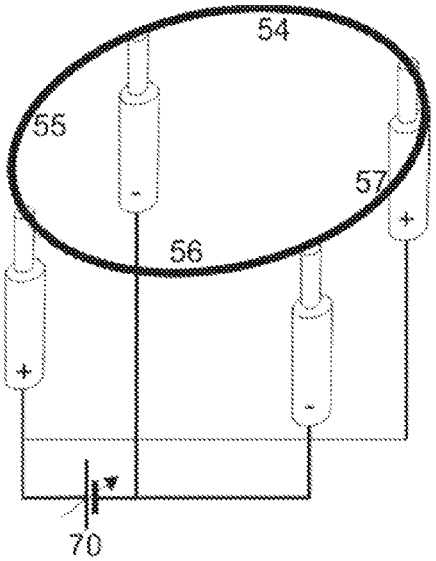
FIG. 9 shows a simple supply circuit for the heating current, based on a single DC voltage generator (70).

All filament segments may be heated in common by a single DC voltage generator (70), as shown in FIG. 9, for example.

Figure 7:
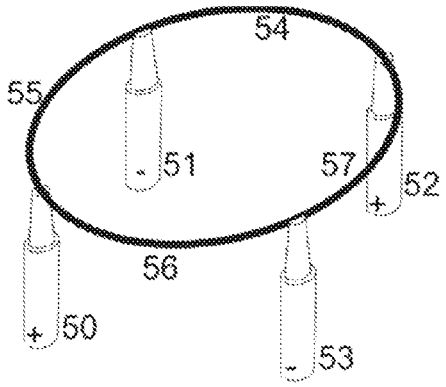
FIG. 7 depicts a filament system with four posts (50) to (53), the diameter of which is smaller at the contacting ends. The diameter is chosen such that the ends of the posts are heated by the current to about the same temperature as the temperature of the ring segments (54) to (57). In this way, there is no (or at least much less) heat being carried away via the posts.

The filaments are preferentially fabricated from Tungsten or from thoriated Tungsten, the Thorium decreasing the electron work function for an easier emission of electrons. Other favorable materials are Rhenium, Yttrium coated Rhenium, or especially Yttrium/Rhenium alloys. To prevent heat being carried away from the filament via the posts, the current supply posts may have a reduced diameter near the contact point to the filament so that they are heated by the current to a temperature which essentially corresponds to the temperature of the filament system. FIG. 7 shows the posts with reduced diameters at the contact end; the conical shape of the posts is chosen in such a way that the temperature at the top of the cone equals the temperature of the filament, wherein the fact has to be considered that the posts carry twice the current which flows through the filament segments. Special care has to be directed towards the fabrication of a good contact. The posts may be manufactured from a variety of materials, e.g., stainless steel for the thicker shaft, and non-thoriated Tungsten for the part with reduced diameter. Favorably, the current supply posts have a higher work function than the filament; they should not emit a high electron current.

Figure 14:
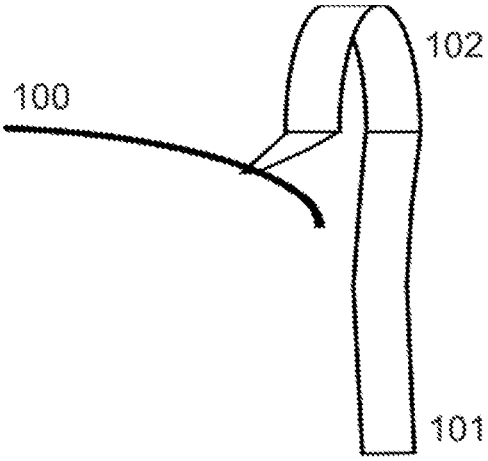
FIG. 14 shows a section of the filament (100) held and supplied with electric current by a pre-tensioned post (101) and a pre-tensioned bow (102). The filament post and bow may be fabricated as a ribbon or blade from resilient material.

Instead of solid current supply posts, we also may use resilient posts to take up the mechanical force during the thermal expansion of the filament. The resilient posts may particularly be made from elastic ribbon made out of steel or other highly elastic metal. In FIG. 14, a solution with spring-tensioned posts (101) to hold the filament (section 100) is shown. The posts, or at least parts of the posts, are made out of a material which will preserve its resilient properties at higher temperature (like Molybdenum). At the contact end, the posts can have a bow or arcuate shape (102) to provide the spring effect, and the posts preferably also have a narrower, thinner (hot) end near the contact with the filament in order to minimize heat loss from the filament.

Figure 11:
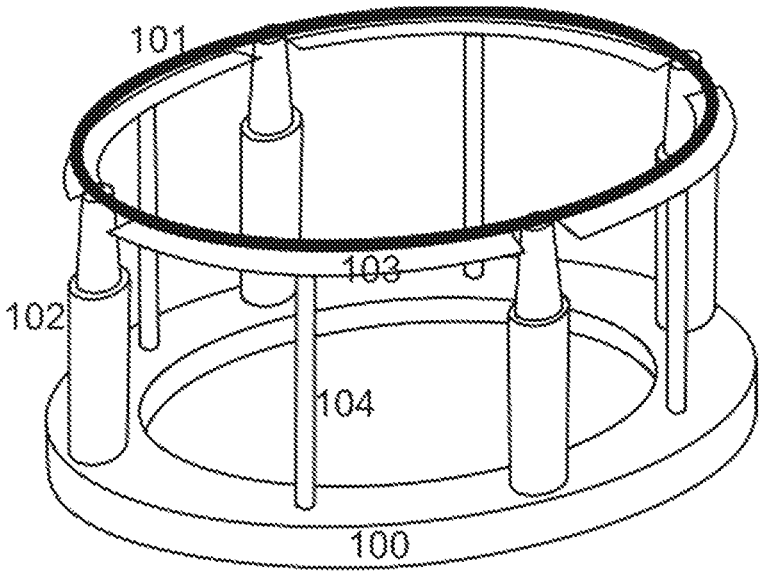
FIG. 11 presents a complete cathode arrangement, mounted on an insulating ring (100). The four current supplying posts (102) hold the ring-shaped filament (101), whereas the four leaner posts (104) are not connected to the heating current circuit but carry four repeller electrodes (103) below the segments of the filament. When mounted in an ion source, the repeller electrodes are supplied with negative potential; they help to drive the electrons emitted from the filament (101) into the ionization region. When mounted in a special ablation station, the repeller electrodes may act as Faraday cups and allow for individual measurements of the electron emission of the four filament segments depicted.

A complete cathode arrangement is presented in FIG. 11 by way of example, mounted on an insulating ring (100), electrical connections not shown. The four current supplying posts (102) with conical tapering hold the ring-shaped filament (101), whereas the four posts (104) carry four repeller electrodes (103) below the segments of the filament. The repeller electrodes, here shown as flat, arcuate electrodes (103), may be bent to half-pipes, running parallel to and opposing the filament segments on one side. When mounted in an ion source, the repeller electrodes are supplied with negative potential; they help to drive the electrons emitted from the filament into the ionization region (upward direction in FIG. 11).

Figure 10:
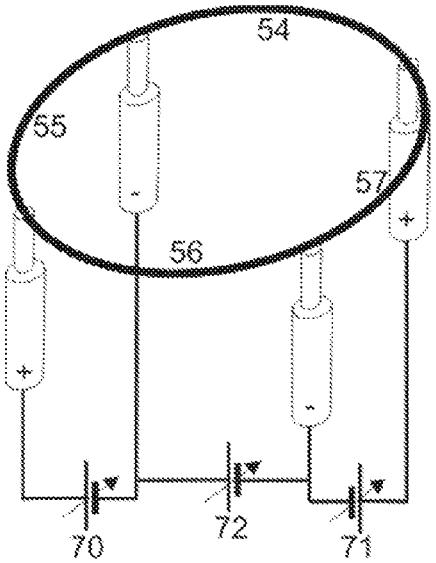
FIG. 10 shows an example of a special electric circuit unit delivering the heating current. Generators (70) and (71) are the main electric generators to produce the heating voltage; generator (72) is a correction voltage generator with low internal resistance, to balance the electron emission of segments (54) and (56). The whole circuit therefore compensates for imbalances of the electron emissions from the four segments.

When using more than two current supply posts, it is challenging to connect the posts with the filament in such a manner that the filament segments have exactly the same electrical resistance. As a result, the segments may show slightly different temperatures, resulting in different electron emission characteristics. To achieve identical electron emission from the filament segments, special current supply circuits may be used. FIG. 10 shows a supply unit comprising three DC voltage generators, to somewhat balance out the different electron emissions and achieve a more homogenous performance.

To achieve identical electron emissions from all segments, using only a single voltage generator for the filament as seen in FIG. 9, the segments of the filament may be treated to show the same resistance, e.g., by ablation. The material of some filament segments may be actively ablated, for instance by blowing some halogen vapor onto the glowing filament, to achieve the same electrical resistance in all segments. If, for instance, iodine vapor is blown as a small jet to segments with higher temperature, the Tungsten reacts with the iodine and the Tungsten iodide evaporates. The resistance will increase and current and electron emission will decrease. The ablation may be performed in a special ablation station in which it is possible to measure the individual electron emission of the single segments. On the other hand, the ablation may be performed actively by laser ablation in a similar ablation station. In FIG. 11, we see a complete arrangement of the filament (101), mounted by four posts (102) to an insulating ring (100). In addition, there are four repeller electrodes (103), mounted by separate posts (104). When mounted in a special ablation station, the repeller electrodes may be used to measure the individual electron emissions of the four segments, and to control the ablation process.

The basic principle of the invention provides a cathode system for the delivery of electrons in an electron impact ion source, comprising a filament and current supply posts connected to the filament, the current supply posts (electrically) dividing the filament into segments, each current supply post supplying or returning the current for at least two segments of the filament. The filament may have the shape of a closed ring or a helical coil; the current supply posts may be spot welded to the filament.

To avoid heat being carried away from the filament via the current supply posts, the posts may have a reduced diameter and/or increased electrical resistance near the locations of contact to the filament so that they are heated by the current to about the temperature of the filament. The filament segments may be ablated to show the same electron emission characteristics; on the other hand, a special electric circuit may be used to achieve the same electron emission characteristics at all individual segments. The filament may be made from Tungsten, particularly from thoriated Tungsten. Other favorable materials are Rhenium, Yttrium coated Rhenium, or especially Yttrium/Rhenium alloys. The current supply posts may, at least partially, be made from Tungsten or Rhenium.

The invention has been described with reference to a plurality of embodiments thereof. It will be understood, however, that various aspects or details of the invention may be changed, or various aspects or details of different embodiments may be arbitrarily combined, if practicable, without departing from the scope of the invention. Furthermore, the foregoing description is for the purpose of illustration only, and not for the purpose of limiting the invention which is defined solely by the appended claims.

The invention claimed is:

1. An Electron Ionization (El) source comprising a cathode system for the delivery of electrons and further comprising a filament and a plurality of current supply posts connected to the filament, the plurality of current supply posts dividing the filament into a plurality of segments, and each current supply post supplying or returning the current for at least two segments of the filament, wherein the current supply posts, or parts of the posts, are made from resilient material.

2. The El source according to claim 1, wherein the segments of the filament are arranged in a row.

3. The El source according to claim 2, wherein the segments of the filament are arranged in the shape of a ring or helical coil.

4. The El source according to claim 1, wherein the current supply posts are spot welded to the filament.

5. The El source according to claim 1, wherein the current supply posts have at least one of a reduced diameter and an increased electrical resistance near the locations of contact to the filament.

6. The El source according to claim 5, wherein parts of the current supply posts with reduced diameter are fabricated from Tungsten or Rhenium.

7. The El source according to claim 1, wherein the current supply posts, or parts of the posts, are made from Molybdenum.

8. The El source according to claim 1, wherein the filament material of some segments is ablated to achieve the same electron emission in all segments.

9. The El source according to claim 1, further comprising an adjustable electric voltage generator for the delivery of the heating current.

10. The El source according to claim 1, further comprising a plurality of adjustable electric voltage generators for the delivery of heating currents to achieve about the same electron emission from all segments.

11. The El source according to claim 1, wherein the filament is made from Tungsten.

12. The El source according to claim 11, wherein the filament is made from thoriated Tungsten.

13. The El source according to claim 1, wherein the filament is made from Rhenium, Yttrium coated Rhenium, or Yttrium/Rhenium alloys.

14. An Electron Ionization (El) source comprising a cathode system for the delivery of electrons and further comprising a filament and a plurality of current supply posts connected to the filament, the plurality of current supply posts dividing the filament into a plurality of segments, and each current supply post supplying or returning the current for at least two segments of the filament, wherein the filament essentially has a plurality of convexities fastened to the current supply posts.

15. An Electron Ionization (El) source comprising a cathode system for the delivery of electrons and further comprising a plurality of filaments serially connected substantially in parallel to a plurality of current supply posts, wherein each current supply post supplies or returns the current for at least one of the plurality of filaments, wherein a diameter of the current supply posts becomes smaller beyond each contact point with a filament.

16. An Electron Ionization (El) source comprising a cathode system for the delivery of electrons and further comprising a filament and a plurality of current supply posts connected to the filament, the plurality of current supply posts dividing the filament into a plurality of segments, and each current supply post supplying or returning the current for at least two segments of the filament, wherein a diameter of each current supply post tapers up to a contact point with the filament.

17. The El source according to claim 16, wherein the tapering is conical.

* * * * *